US007463473B2

(12) United States Patent
Eldery et al.

(10) Patent No.: US 7,463,473 B2
(45) Date of Patent: Dec. 9, 2008

(54) RESONANCE FIELD DISCHARGE

(75) Inventors: Mohamed A. Eldery, Mississauga (CA); Robert D. Paton, Caledon (CA)

(73) Assignee: Honeywell International, Inc., Morristown, NJ (US)

( * ) Notice: Subject to any disclaimer, the term of this patent is extended or adjusted under 35 U.S.C. 154(b) by 0 days.

(21) Appl. No.: 11/737,002

(22) Filed: Apr. 18, 2007

(65) Prior Publication Data

US 2008/0259509 A1 Oct. 23, 2008

(51) Int. Cl.
*H01H 47/00* (2006.01)

(52) U.S. Cl. ..... 361/155; 361/155; 361/156

(58) Field of Classification Search ..... 361/21, 361/155, 156; 363/97
See application file for complete search history.

(56) References Cited

U.S. PATENT DOCUMENTS 5,642,033 A 6/1997 Bartol et al.
5,932,993 A 8/1999 Kouwa et al.
6,072,301 A * 6/2000 Ashtiani et al. ..... 320/128
6,233,165 B1 * 5/2001 Irissou et al. ..... 363/97

FOREIGN PATENT DOCUMENTS

DE 19935260 A1 2/2000
JP 58015466 A 1/1983
JP 2002272135 A 9/2002
JP 2007097261 A 4/2007

OTHER PUBLICATIONS

European search report dated Jul. 3, 2008.

* cited by examiner

*Primary Examiner*—Michael J Sherry
*Assistant Examiner*—Tien Mai
(74) *Attorney, Agent, or Firm*—Oral Caglar, Esq.

(57) ABSTRACT

A field discharge circuit may rapidly reduce the field current of a generator, thereby avoiding an overvoltage condition. The field discharge circuit of the present invention may use another storage device, such as a capacitor, to quickly transfer the field current energy thereto and then slowly dissipate the transferred energy after the event (such as removal of a load) has passed. By transferring this energy to a storage device and subsequently slowly discharging this energy through a resistor, electromagnetic interference caused by a conventional resistive discharge can be reduced.

18 Claims, 3 Drawing Sheets

RESONANCE FIELD DISCHARGE

BACKGROUND OF THE INVENTION

The present invention generally relates to field current discharge and, more specifically, to systems and methods for discharging current to eliminate damage caused by generator overvoltage when a load is removed.

The output of a generator or alternator may be regulated by comparing the voltage at a point of regulation (POR) with a reference voltage and using a voltage regulator to maintain the output voltage at a desired level. Some systems now require generators that limit overvoltage to about 150V rms for 115 V AC electrical systems and to about 300 V rms for 230 V AC electrical systems.

A conventional approach to overvoltage protection is to monitor voltage levels and disconnect the generator or alternator from the power supply when an overvoltage is detected. This approach, however, is too slow to provide effective control and protection against overvoltage conditions.

For synchronous alternator applications, fast field current discharge is required to eliminate the damages caused by overvoltage that occurs during load removal. Voltage regulator circuitry and the field winding exist to regulate the terminal voltage of the generator to meet the predetermined specifications. During the load removal, the generator terminal voltage increases due to reduced losses. Therefore, the voltage regulator is engaged to reduce the field current. The field power supply is unidirectional, so the stored energy in the form of the field current has to be dissipated in the field resistance. Since the field resistance is very small, the recovery time is large and it takes a long time to reduce the field current and, consequently, a longer overvoltage appears on the generator terminals.

One conventional approach to overvoltage protection uses a discharge resistance to dissipate the field current energy. The larger the discharge resistance, the shorter the recovery time. Discharging the field current through a high resistance value results in high voltage across the discharge resistance, which could exceed the aircraft and components safe working voltage. In addition, a special resistor, with high pulse energy rating, is required, which adds to the circuit cost.

Although discharging the field current through a resistance can be fast, the discharge time is limited by the voltage across the given resistance. For ideally fast discharge time, a prohibitively large resistance may be necessary. Therefore, due to the inability to use such large resistances, the discharge time would not be as fast as required. Additionally, a large electromagnetic interference pulse is produced during a resistive discharge which could disturb surrounding electronic equipment.

Referring to FIG. 1A, there is shown a generator field circuit 10 having a constant direct current (DC) voltage source, $+V_{DC}$ and $-V_{DC}$. The voltage regulator (VR) 12 provides a command signal 14 to the pulse width modulator (PWM) circuit 16 which triggers a PWM-transistor 18. The transistor 18 is used to chop the $V_{DC}$, controlling the field voltage and consequently the field current 30. During load removal, the generator output terminal voltage 20 rises and the voltage regulator 12 commands the PWM circuit 16 to reduce the field current 30. The field current 30, however, keeps circulating through the free-wheeling diode 22.

Referring to FIG. 1B, there is shown a conventional circuit 24 for discharging the field current 30 quickly using a resistance 26. A field discharge circuit 28 is added in series with the free wheeling diode 22 in the field circuit 10 (see FIG. 1A) to quickly reduce the field current 30. The field discharge circuit 28 may include the resistor 26 and a field discharge transistor 32. As discussed above, the discharge time is limited by the voltage across the resistance. Additionally, a large electromagnetic interference pulse is produced during a resistive discharge which could disturb surrounding electronic equipment.

As can be seen, there is a need for a field current discharge circuit and method that may quickly reduce the field current without requiring a large resistance which may emit electromagnetic interference pulses.

SUMMARY OF THE INVENTION

In one aspect of the present invention, a resonance field discharge circuit comprises a field discharge transistor switching between an ON position and an OFF position; a storage device for receiving and storing field energy when the field discharge transistor is in the OFF position; and a discharge resistor for discharging the field energy stored in the storage device.

In another aspect of the present invention, a method for reducing the duration and the level of an overvoltage condition in a generator comprises determining that an overvoltage condition exists; turning OFF a field discharge transistor to allow field current to be transferred to a storage device; and turning ON the field discharge transistor to allow for the discharge of the energy stored in the storage device.

In a further aspect of the present invention, a field discharge circuit for reducing the duration and the level of an overvoltage condition of a generator comprises a field discharge transistor switching between an ON position and an OFF position; capacitor for receiving and storing field energy when the field discharge transistor is in the OFF position; and discharge resistor for discharging the field energy stored in the capacitor, wherein the discharge resistor discharges the field energy stored in the capacitor when the field discharge transistor is in the ON position.

These and other features, aspects and advantages of the present invention will become better understood with reference to the following drawings, description and claims.

DETAILED DESCRIPTION OF THE INVENTION

The following detailed description is of the best currently contemplated modes of carrying out the invention. The description is not to be taken in a limiting sense, but is made merely for the purpose of illustrating the general principles of the invention, since the scope of the invention is best defined by the appended claims.

Broadly, the present invention provides a resonance field discharge circuit for rapidly reducing the field current of a generator, thereby avoiding an overvoltage condition. The present invention may use a storage device, such as a capacitor, to quickly transfer the field current energy thereto and then slowly dissipate the transferred energy after the event (such as removal of a load) has passed. By transferring this energy to a storage device and subsequently slowly discharging this energy through a resistor, electromagnetic interference caused by a conventional resistive discharge can be reduced.

Conventional field discharge circuits may rely upon discharge resistance to dissipate the field current energy. In these conventional systems, however, the specifications for field current discharge may require the use of a large resistor in order to handle the desired field current discharge. Moreover, a large electromagnetic pulse may be produced during a resistive discharge. The field discharge circuit of the present invention avoids or minimizes electromagnetic pulses by transferring the energy stored in the field inductance to a storage device, such as a capacitor. After the field current is reduced, the energy in the storage device of the present invention may be slowly dissipated by a bleed resistor, thereby avoiding the need for large wattage or large resistance features in the discharge resistor as well as avoiding large electromagnetic interference by conventional rapid resistive discharge.

Figure 1A:
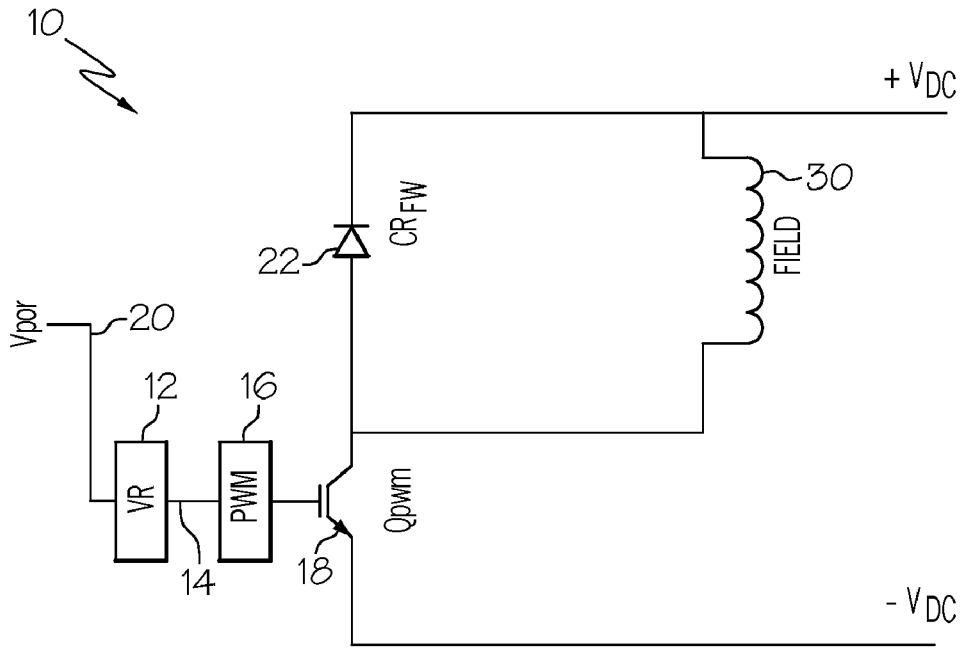
FIG. 1A (PRIOR ART)
FIG. 1A is a schematic drawing of a generator field circuit having a constant DC voltage source according to the prior art.
Figure 1B:
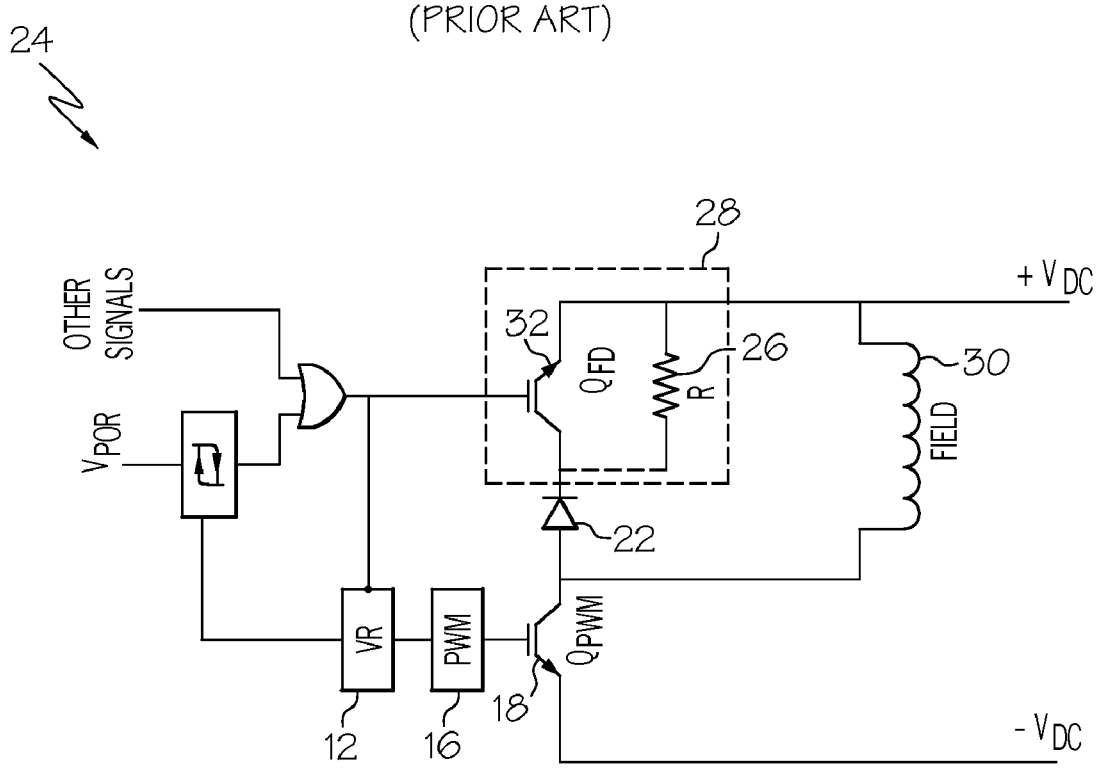
FIG. 1B (PRIOR ART)
FIG. 1B is a schematic drawing of a resonance field discharge circuit according to the prior art.
Figure 2:
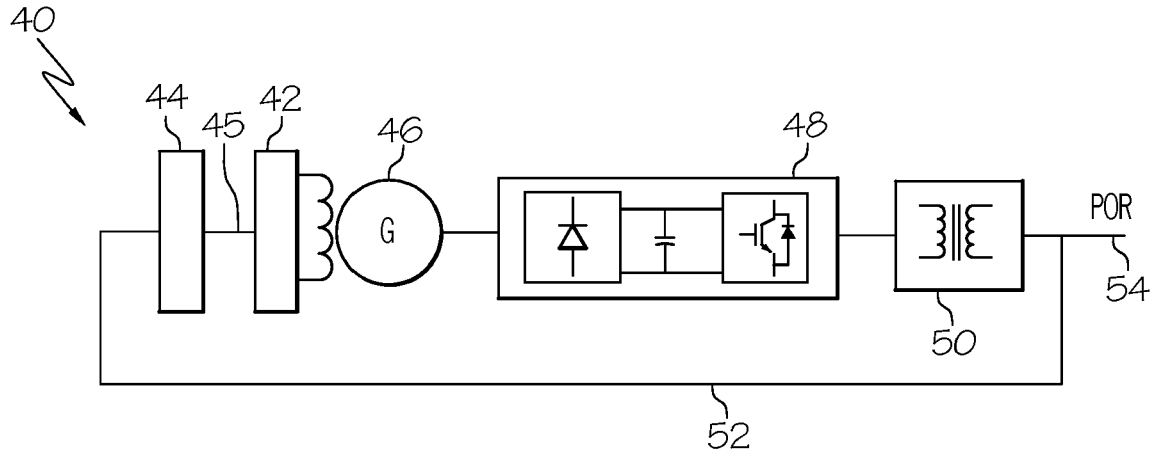
FIG. 2 is a schematic block diagram showing a synchronous generator application using the field discharge circuit of the present invention.

Referring to FIG. 2, there is shown a schematic block diagram of a synchronous generator application 40 using a field discharge circuit 42 according to the present invention. A voltage regulator 44 may provide a command signal 45 to the field discharge circuit 42. The field discharge circuit may be used to regulate the field current at a generator 46. The generator 46 may be electrically connected to an alternating current (AC)/DC/AC converter 48 for providing the desired current from the generator. The currents may then pass through a transformer 50 to a point of regulation (POR) 54 which may provide power to the loads (not shown). A signal 52 reflective of the current and voltage at the POR 54 may be delivered back to the voltage regulator 44 to provide the command signal 45 to the field discharge circuit 42.

Figure 3:
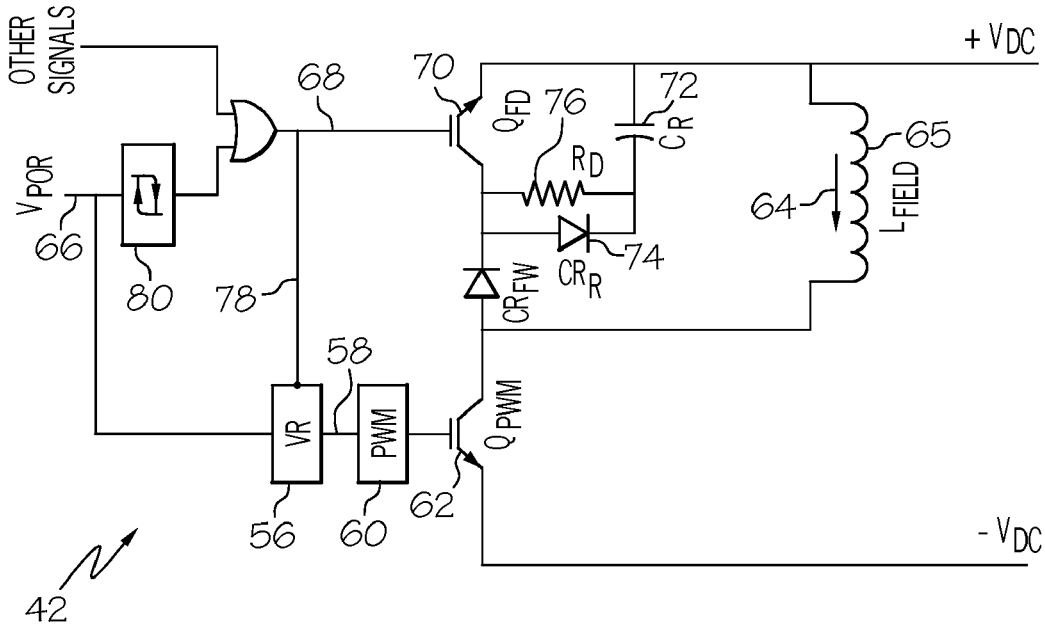
FIG. 3 is a field control circuit with field discharge according to one embodiment of the present invention.

Referring to FIG. 3, there is shown a field discharge circuit 42 with field discharge according to one embodiment of the present invention. The field discharge circuit 42 may have a constant direct current (DC) voltage source, $+V_{DC}$ and $-V_{DC}$. A voltage regulator 56 may provide a command signal 58 to a PWM circuit 60 which triggers a PWM-transistor 62. The transistor 62 may be used to chop the $V_{DC}$, controlling the field voltage and consequently the field current 64. During load removal, the generator output terminal voltage at the POR 66 may rise and the voltage regulator 56 may command the PWM circuit 60 to reduce the field current 64.

The field discharge circuit 42 may sense the voltage at the POR 66 and control a switching signal 68 to a field discharge transistor 70 as discussed below. A hyertsis control 80 may be used to avoid multiple triggers of the field discharge circuit 42. The hyertsis control 80 may have two limits, an upper limit and a lower limit. When the voltage at the POR 66 is less than the lower limit, the output of the hyertsis control 80 will be high and consequently, the transistor 70 is ON. If the signal at the POR 66 is higher than the upper limit, the hyertsis control 80 output is low, which may turn the transistor 70 OFF to engage the field discharge circuit 42. The other signals shown in FIG. 3 may by any signals that might be required to engage the field discharge circuit 42 under different circumstances, such as loss of POR sensing. When the voltage at the POR 66 is less than or equal to a set point, the field discharge transistor 70 may be set to ON, allowing the field current 64 to circulate through the field discharge transistor 70. The set point, not shown, may be a desired voltage output of the generator. In other words, the set point may be a condition in which there is no overvoltage condition. When the voltage at the POR 66 is greater than the set-point, the field discharge transistor 70 may be set to OFF, allowing the field current 64 to be transferred to a resonance capacitor 72 via a resonance diode 74. The field discharge transistor 70 may be OFF for a time period long enough to transfer the field current 64 energy from the field inductance 65 to the capacitor 72. This time period may be equal to a quarter of the time-base of the resonance between the field inductance 65 and the capacitor 72 and is given as $$T_R = \frac{1}{4}\left(2\pi\sqrt{L_{Field}C_R}\right)$$

wherein $L_{Field}$ is the field inductance, $C_R$ is the capacitance of the capacitor 72 and $T_R$ is the time-base of the resonance.

During this time period, the energy stored in the field inductance (in terms of current) will be stored in the capacitor 72 (in terms of voltage). After this time period $$\left(\frac{T_R}{4}\right),$$

the field discharge transistor may be turned ON, allowing the field current 64 to build up again while discharging the energy stored in the capacitor 72 through a discharge resistor 76. The discharge time constant, $\tau_D$ may be determined by $$\tau_D = C_R R_{FD}$$

wherein $C_R$ is the capacitance of the capacitor 72 and $R_{FD}$ is the resistance of the discharge resistor 76.

Since the discharge time does not affect the field current 64 or the voltage at the POR 66, the time constant is chosen to be long, therefore the energy rating of the discharge resistor 76 may be dramatically smaller than conventional discharge resistors, which must dissipate the field current in a relatively short period of time. To avoid multiple triggers of the field discharge circuit 42, the integral part of the voltage regulator 56 may be RESET via a reset signal 78 after each trigger of the field discharge circuit 42.

Figure 4:
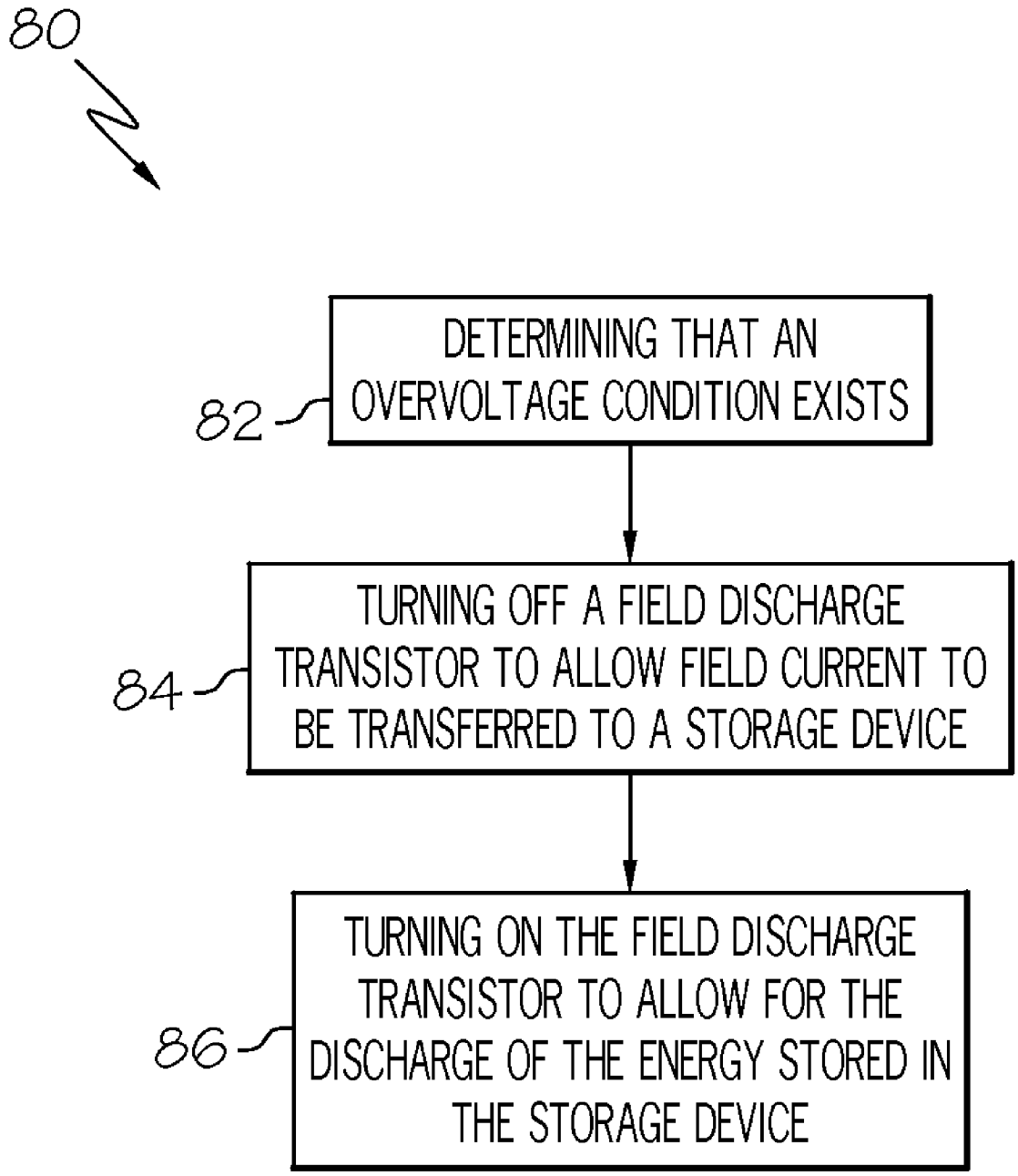
FIG. 4 is a flow chart describing a method according to an embodiment of the present invention.

Referring now to FIG. 4, there is shown a flow chart 80 describing a method for reducing the duration of an overvoltage condition. A first step 82 may include determining if an overvoltage condition exists. In this step, the output voltage may be measured (for example at the POR 66) to determine whether the generator is operating at or above its set point. If there is an overvoltage condition, the next step 84 may include turning OFF a field discharge transistor (e.g., field discharge transistor 70) to allow the field current to be transferred to a storage device (e.g., resonance capacitor 72). The time that the field discharge transistor is OFF may be determined as described above. After this time passes, a step 86 may include turning ON the field discharge transistor to allow for the discharge of the energy stored in the storage device. This energy may be discharged through a discharge resistance (e.g., discharge resistor 76, thereby placing the field discharge circuit at the ready to detect an overvoltage condition, such as that done in the first step 82.

EXAMPLE

An aircraft generator was suffering from frequent trips and damage to its power pass. Analysis and tests showed that the root cause of such trips and damage was mainly due to the overvoltage which occurred after a large load was removed. The conventional fast field discharge circuit may use a 120 ohm resistor. Based on the field inductance of 100 mH, the time constant was 1 ms, with a total discharge time of about 5 ms. This conventional improvement reduced the overvoltage spikes by more than about 40% and reduced the overvoltage duration by greater than 50%.

Using the same conditions and the above provided equations, the present invention would provide a solution to the aircraft generator problem by using a 6.4 uf capacitor. This would give a $T_R$ (field discharge time) as 1.5 ms. Because the field discharge time is reduced from 5 ms to 1.5 ms with the present invention, the overvoltage will be less and of a shorter duration. $R_{FD}$ is chosen to be 3.1K ohm, or any appropriate value, as $\tau_D$ does not affect the field current. For example, for a slow field discharge time, the discharge resistor may be chosen to be about 100K ohm. A larger resistor may more be able to dissipate larger voltages over longer periods of time. While the above example describes the use of 3.1K ohm and 100K ohm resistors as the discharge resistor, the above example is meant as non-limiting a example. Specific resistances may be chosen depending on the application.

It should be understood, of course, that the foregoing relates to exemplary embodiments of the invention and that modifications may be made without departing from the spirit and scope of the invention as set forth in the following claims.

We claim:

1. A resonance field discharge circuit comprising:

a field discharge transistor switching between an ON state and an OFF state;

a capacitor connected to the field discharge transistor so that the capacitor receives and stores field energy when the field discharge transistor is in the OFF state;

a discharge resistor connected to the capacitor so that the discharge resistor discharges the field energy stored in the capacitor; and a time during which the field discharge transistor is in the OFF state is governed by the formula $$T_R = \frac{1}{4}\left(2\pi\sqrt{L_{Field}C_R}\right)$$

wherein $L_{Field}$ is a field inductance of a generator, $C_R$ is the capacitance of the capacitor.

2. The resonance field discharge circuit according to claim 1, further comprising a voltage regulator which provides a command signal to a pulse width modulation (PWM) circuit.

3. The resonance field discharge circuit according to claim 2, wherein the PWM circuit triggers a PWM transistor to provide a controlled field voltage.

4. The resonance field discharge circuit according to claim 1, further comprising a voltage regulator reset for resetting the voltage regulator to avoid multiple triggering of the field discharge transistor to the OFF state.

5. The resonance field discharge circuit according to claim 1, wherein an overvoltage condition may be limited by about 150V rms for 115 VAC electrical systems and about 300 V rms for 230 VAC electrical systems by the field discharge circuit.

6. The resonance field discharge circuit according to claim 1, wherein the field discharge transistor is in an OFF state when a generator creates an overvoltage condition.

7. The resonance field discharge circuit according to claim 1 , wherein the discharge resistor is at least about 3.1K ohm, thereby allowing controlled resistive discharge of the field energy and reducing any electromagnetic interference pulses.

8. The resonance field discharge circuit according to claim 1, wherein the field discharge circuit is used to control an overvoltage condition of a synchronous generator.

9. A method for reducing the duration and the level of an overvoltage condition in a generator, the method comprising:

determining that an overvoltage condition exists;

turning OFF a field discharge transistor to allow field current to be transferred to a capacitor when the overvoltage condition exists;

leaving the field discharge transistor OFF for a time determined by the formula:

$$T_R = \frac{1}{4}\left(2\pi\sqrt{L_{Field}C_R}\right)$$

wherein $L_{Field}$ is a field inductance of a generator, $C_R$ is the capacitance of the capacitor; and turning ON the field discharge transistor to allow for the discharge of the energy stored in the capacitor during the time in which the field discharge transistor was turned OFF.

10. The method according to claim 9, wherein generator output voltage is measured to determine whether an overvoltage condition exists.

11. The method according to claim 9, further comprising receiving the energy stored in the capacitor into a resistor.

12. The method according to claim 11, further comprising dissipating the energy received into the resistor.

13. A field discharge circuit for reducing the duration and the level of an overvoltage condition of a generator, the field discharge circuit comprising:

a field discharge transistor switching between an ON state and an OFF state;

a capacitor connected to the field discharge transistor so that the capacitor receives and stores field energy when the field discharge transistor is in the OFF state;

a discharge resistor;

the capacitor positioned on a first current path on which the discharge resistor is not present so that field energy bypasses the discharge resistor when the field discharge transistor is in the OFF state;

the field discharge transistor being in the OFF state for a time determined by the formula:

$$T_R = \frac{1}{4}\left(2\pi\sqrt{L_{Field}C_R}\right)$$

wherein $L_{Field}$ is a field inductance of a generator, $C_R$ is the capacitance of the capacitor; and the discharge resistor connected to the capacitor on a second current path so that the discharge resistor discharges the field energy stored in the capacitor into the discharge resistor only when the field discharge transistor is in the ON state.

14. The field discharge circuit according to claim 13, further comprising a voltage regulator for providing a command signal to a pulse width modulation (PWM) circuit, wherein the PWM circuit triggers a PWM transistor to provide a controlled field voltage for the generator.

15. The field discharge circuit according to claim 13, further comprising a voltage regulator reset for resetting the voltage regulator to avoid multiple triggering of the field discharge transistor to the OFF state.

16. The field discharge circuit according to claim 13, wherein an overvoltage condition may be limited by about 150V rms for 115 VAC electrical systems and about 300 V rms for 230 VAC electrical systems by the field discharge circuit.

17. The field discharge circuit according to claim 13, wherein the field discharge transistor is in an OFF state when the generator creates an overvoltage condition.

18. The field discharge circuit according to claim 13, wherein the discharge resistor is at least about 3.1K ohm, thereby allowing controlled resistive discharge of the field energy and reducing any electromagnetic interference pulses.

* * * * *